United States Patent [19]

Thompson

[11] 4,068,100

[45] Jan. 10, 1978

[54] METHOD AND APPARATUS FOR TRANSMITTING AND RECEIVING AMPLITUDE MODULATED STEREO

[75] Inventor: Thomas F. Thompson, Eugene, Oreg.

[73] Assignee: Pacific Northwest Broadcasting Corporation, Eugene, Oreg.

[21] Appl. No.: 749,907

[22] Filed: Dec. 13, 1976

Related U.S. Application Data

[63] Continuation of Ser. No. 564,805, April 3, 1975, abandoned, which is a continuation of Ser. No. 437,012, Jan. 28, 1974, abandoned, which is a continuation of Ser. No. 266,513, June 22, 1972, abandoned, which is a continuation of Ser. No. 879,079, Nov. 24, 1969, abandoned, which is a continuation-in-part of Ser. No. 618,373, Feb. 24, 1967, abandoned.

[51] Int. Cl.[2] ..... H04H 5/00

[52] U.S. Cl. ..... 179/15 BT; 325/366; 325/160

[58] Field of Search ..... 179/15 BT, 1 G; 325/36, 325/160, 169, 365, 366, 373, 374

[56] References Cited

U.S. PATENT DOCUMENTS

| | | | |
|---|---|---|---|
| 1,906,269 | 5/1933 | Hough | 325/139 |
| 1,957,537 | 5/1924 | Jenkins | 179/15 BT |
| 2,259,658 | 10/1941 | Parker | 325/160 |
| 2,403,957 | 7/1946 | Seeley | 179/15 BT |
| 2,802,938 | 8/1957 | Herzog | 325/373 |
| 2,851,592 | 9/1958 | Webster | 325/373 |
| 3,143,600 | 8/1964 | De Vries | 179/15 BT |

*Primary Examiner*—Douglas W. Olms
*Attorney, Agent, or Firm*—Oliver D. Olson

[57] ABSTRACT

The transmission of amplitude modulated stereo is achieved by modulating the positive and negative half cycles of a radio frequency carrier separately with a different one of the channels carrying the audio intelligence of a stereo program, thereby transmitting both stereo channels on the same carrier. The modulation is done after final amplification of the carrier signal, directly in the antenna circuit, in order to eliminate mixing of the two channels, and is achieved by utilizing each half cycle of radio frequency antenna current to activate separate modulators each connected to a different one of the sources of audio frequency intelligence signals. Reception of this transmission is achieved by inserting a radio frequency diode in the resonant circuit of each of two receiving antennas in opposite directions, whereby each antenna circuit is responsive only to a different one of the two channels.

6 Claims, 4 Drawing Figures

FIG. 1
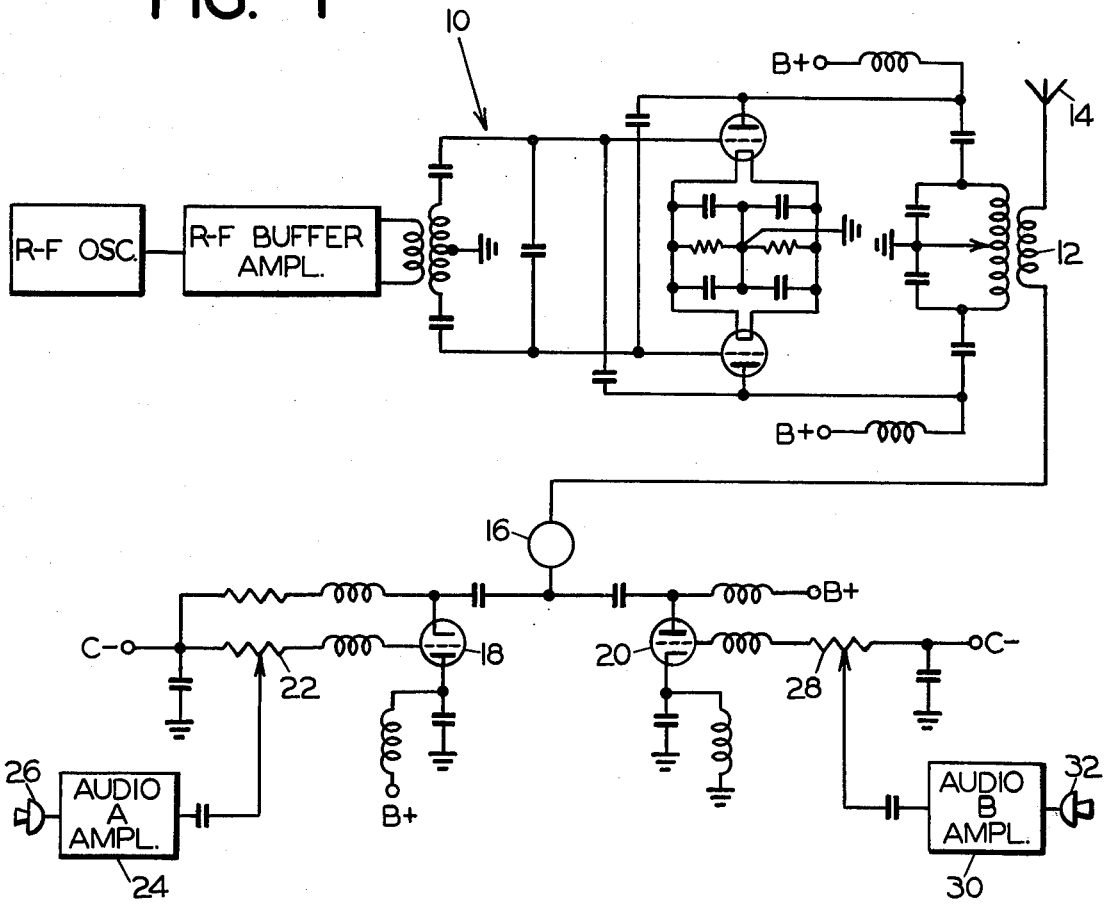
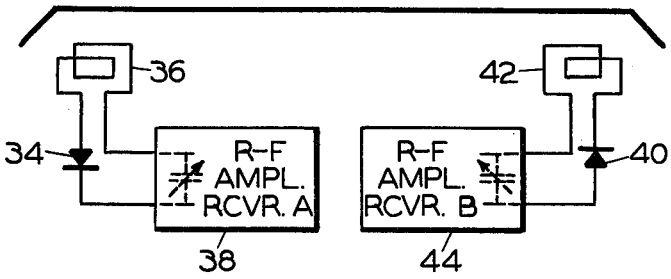
FIG. 2

METHOD AND APPARATUS FOR TRANSMITTING AND RECEIVING AMPLITUDE MODULATED STEREO

CROSS REFERENCE TO RELATED APPLICATION

This application is a continuation of my earlier filed application Ser. No. 564,805 filed, Apr. 3, 1975 as a continuation of Ser. No. 437,012, filed Jan. 28, 1974 as a continuation of Ser. No. 266,513, filed June 22, 1972 as a continuation of Ser. No. 879,079, filed Nov. 24, 1969 as a continuation-in-part of Ser. No. 618,373, filed Feb. 24, 1967, all of which earlier filed applications are now abandoned.

BACKGROUND OF THE INVENTION

This invention relates to the transmission and reception of stereo programs, and more particularly to the transmission and reception of amplitude modulated stereo.

Stereo transmission and reception heretofore has involved the use of a frequency modulated channel in association with an amplitude modulated channel. Because of the line-of-sight limitation of frequency modulated transmission, stereo reception is not available in many areas.

Attempts have been made heretofore to devise systems for the transmission of amplitude modulated stereo, to overcome the aforementioned limitation. Such systems have proven to be very costly and also quite deficient in performance, because of excessive distortion and mixing of channel signals, and incompatability with standard amplitude modulated receivers.

SUMMARY OF THE INVENTION

In its basic concept, this invention involves the amplitude modulation of the positive and negative half cycles of radio frequency transmission antenna current with different audio intelligence signals from two program channels, transmitting the modulated carrier for amplitude modulation reception and separating the audio intelligence signals of the two program channels for amplification each by separate audio amplification systems.

This invention achieves the principal objective of avoiding the aforementioned limitations by providing a method and apparatus for the transmission and reception of amplitude modulated stereo which involves minimum modification of existing transmitting and receiving equipment, affords complete separation and precise mixing of the audio intelligence contained within the two channels, and is fully compatible with standard monaural amplitude modulated receivers.

The foregoing and other objects and advantages of this invention will appear from the following description, taken in connection with the accompanying drawings of preferred embodiments.

BRIEF DESCRIPTION OF THE DRAWINGS

FIG. 1 is a schematic electrical diagram, partly in block form, of a low level amplitude modulated stereo transmitting system embodying the features of this invention.

FIG. 2 is a schematic electrical diagram, partly in block form, showing the manner in which a pair of receiving antenna circuits are arranged each for reception of a different channel.

DESCRIPTION OF THE PREFERRED EMBODIMENTS

Figure 3:
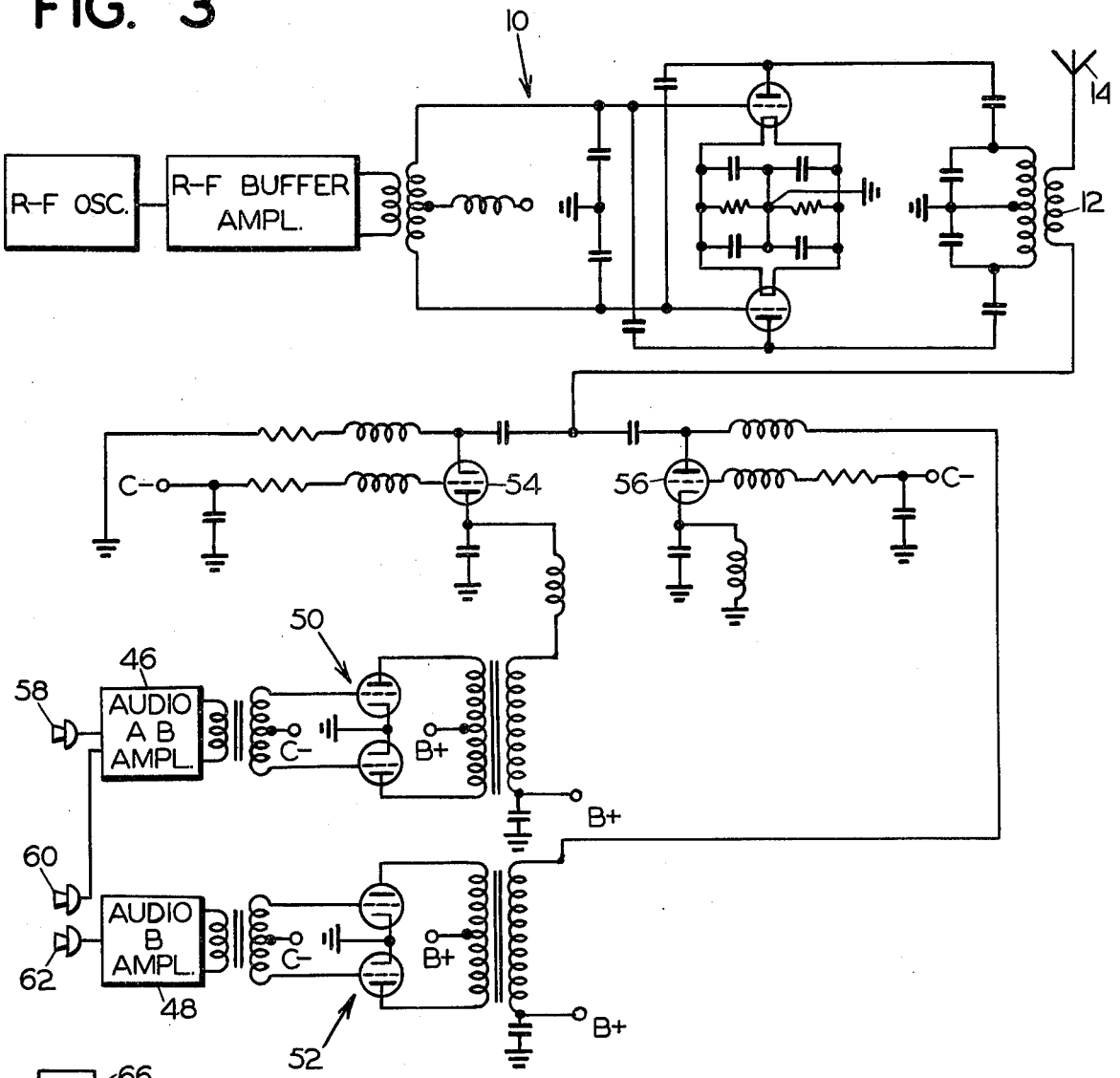
FIG. 3 is a schematic electrical diagram, partly in block form, of a high level amplitude modulated stereo transmitting system embodying the features of this invention.

FIG. 1 illustrates a conventional low level amplitude modulated transmitter 10 the final radio frequency amplifier of which is coupled through the final radio frequency tank circuit to a pick-up coil 12 one end of which is connected to a transmitting antenna 14.

The opposite end of the pick-up coil is connected capacitively, preferably through a radio frequency ammeter 16, to a pair of variable tube resistors 18 and 20 arranged in opposition one to the other. These tubes provide no amplification, and hence no neutralization, and function upon activation each by a different half cycle of radio frequency antenna current, to modulate said half cycles of antenna current separately with different audio frequency intelligence signals.

Thus, the plate of tube 18 is connected to a source of positive potential, the cathode is connected capacitively through the ammeter to the pick-up coil 12, and the grid is connected through a potentiometer 22 to the output of channel A audio amplifier 24, the imput of which is connected to a microphone pickup 26 by which acoutical energy is converted to audio frequency signals for channel A of a stereo program.

The cathode of variable tube resistor 20 is connected to ground, its plate is connected capacitively through the ammeter to the pick-up coil 12, and its control grid is connected through a potentiometer 28 to the output of channel B audio amplifier 30, the input of which is connected to a microphone pick-up 32 by which acoutical energy is converted to audio frequency signals for channel B of the stereo program.

From the foregoing it will be appreciated that the variable tube resistor 18 is activated only when antenna current is flowing downward from the antenna, thereby modulating said half cycles of antenna current with channel A audio intelligence signals. Similarly, the variable tube resistor 20 is activated only when antenna current is flowing upward to the antenna, thereby modulating said half cycles with channel B audio intelligence signals.

The ammeter 16 is employed in the adjustment of the system to proper operation, as follows: With the variable tube resistors operating at maximum conduction, the transmitter output is adjusted until the ammeter indicates maximum radio frequency current legally permissible on peaks at 100% audio modulation. The bias voltages for the tubes then are adjusted until the ammeter indicates the antenna current is one-half of the previously indicated maximum. Finally, the potentiometers 22 and 28 are adjusted to increase the stereo audio input loads to the grids of the tubes until the ammeter indicates that maximum antenna current approaches legal maximum and minimum current approaches zero.

By means of the arrangement illustrated in FIG. 1, modulation of the positive and negative half cycles of radio frequency antenna current is accomplished directly between the antenna and its ground. Thus, flow of radio frequency antenna current in one direction is audio modulated by channel A, while flow of radio frequency antenna current in the opposite direction is modulated by channel B. By such modulation of the radio frequency antenna current where no further resonant circuits can act upon the modulated signal, all possibility of mixing of channel A electron energy and channel B electron energy, is eliminated.

FIG. 2 illustrates simplified means for modifying a pair of conventional amplitude modulated receivers to receive amplitude modulated stereo transmission from the system illustrated in FIG. 1. Thus, a radio frequency diode 34 is inserted in one direction in series in the parallel resonant circuit of the antenna 36 of an amplitude modulated receiver 38. Similarly, a radio frequency diode 40 is inserted in the opposite direction in the parallel resonant circuit of the antenna 42 of a second amplitude modulated receiver 44. The diodes, being thus inserted directly in the antennas themselves function to control the direction of electron flow in the antenna circuits and are so arranged that electron flow in one antenna circuit is in the direction opposite that of electron flow in the other antenna circuit. Thus, for example, radiant energy received at antenna 36 causes electrons to flow in its antenna circuit in the direction for use of channel A modulated intelligence at the receiver 38. Similarly, radiant energy received at the antenna 42 causes electrons to flow in its antenna circuit in the opposite direction, for use of channel B modulated intelligence at the receiver 44. Accordingly, the pair of standard amplitude modulated receivers function effectively to receive the amplitude modulated stereo transmission, by the simple and inexpensive insertion of radio frequency diodes in their antenna circuits.

The high level amplitude modulated stereo transmitting system illustrated in FIG. 3 is similar to the system illustrated in FIG. 1 with the exception that the outputs of the audio amplifiers 46 and 48 are coupled through audio modulators 50 and 52, respectively, to the plates of the variable tube resistors 54 and 56, respectively. The latter are activated selectively by the opposite half cycles of radio frequency antenna current, as explained hereinbefore.

A further modification illustrated in FIG. 3 resides in the provision of two microphones 58 and 60 at the input of the audio amplifier 46. These microphones are spaced apart appropriately to pick up the acoutical energy developing the audio frequency intelligence for channels A and B, respectively. These are mixed equally and applied to the plate of the variable tube resistor 54. The other audio amplifier 48 has only the one microphone 62 connected to its input, and this microphone is positioned to pick up the intelligence for channel B only. Thus, there is transmitted from the antenna 14 a single carrier signal in which one of its half cycles (positive or negative) is modulated by the audio modulator carrying the combined intelligence of channels A and B, and the other half cycle (negative or positive) is modulated by the audio modulator carrying the intelligence of channel B only.

Because of the elimination of mixing of channel signals, the receiver system illustrated in FIG. 2 also may be employed effectively to receive stereo transmission from the system illustrated in FIG. 3. However, the receiver system illustrated in FIG. 4 is preferred.

Figure 4:
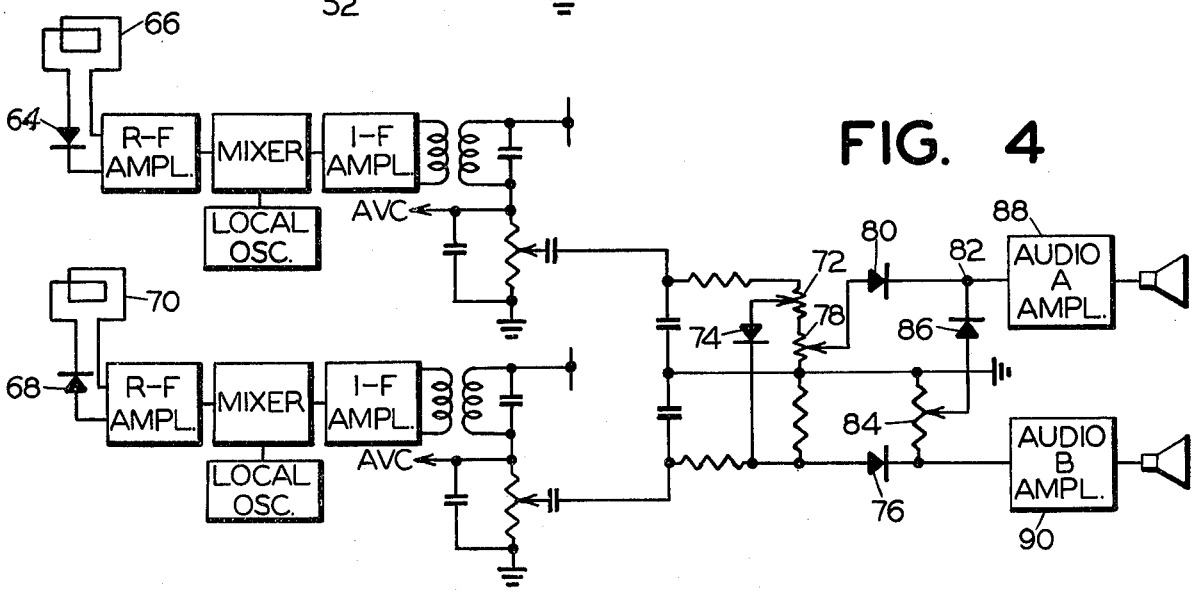
FIG. 4 is a schematic electrical diagram, partly in block form, of a receiving system for accommodating detection at a pair of receiving antenna circuits of the mixed audio intelligence signals transmitted by the apparatus of FIG. 3.

In this regard, FIG. 4 shows a radio frequency diode 64 inserted in one direction in the resonant circuit of antenna 66, for reception of the equal percentages of channels A and B which modulated one-half cycle of the antenna current transmitted by the system of FIG. 3, and a radio frequency diode 68 inserted in the opposite direction in the resonant circuit of antenna 70 for reception of the unequal percentages of channels A and B which modulated the other half cycle of antenna current.

Assuming, for example, that the positive half cycles of antenna current are modulated by equal percentages of channels A and B and that the negative half cycles of antenna current are modulated by 49% channel A and 51% channel B, the potentiometer 72 is adjusted to pass through the diode 74 from the even percentage channel a signal containing 49% channel A and 49% channel B. This signal mixes with the uneven percentage channel, in 180° phase relationship. Accordingly, there is passed through the diode 76 a signal containing only 2% channel B.

Simultaneously, by proper adjustment of the potentiometer 78, the remaining 2% of the even mixture of channels A and B (1% channel A and 1% channel B) is passed through the diode 80 to the junction 82. By appropriate adjustment of the potentiometer 84, 1% of the channel B signal is passed through the diode 86 and mixed at the junction 82 with the 2% channel AB signal, in 180° phase relationship, thereby cancelling the 1% channel B portion of the channel AB signal. Accordingly, a channel A signal only is fed to the audio amplifier 88, and a channel B signal only is fed through to the audio amplifier 90.

The transmission systems illustrated in FIGS. 1 and 3 provide for total separation and very precise mixing of the channels in even or uneven, but legal and fully compatible amounts. This permits standard monaural amplitude modulated receivers to receive such stereocast signals in the usual monaural manner, but with higher fidelity. Moreover, stereo receivers as herein provided receive very high fidelity stereo with absolute minimum distortion.

It will be apparent to those skilled in the art that various changes may be made in the number, type, values and arrangement of components described hereinbefore, without departing from the spirit of this invention.

Having now described my invention and the manner in which it may be used, I claim:

1. The method of transmitting amplitude modulated stereo, comprising:

a. generating a radio frequency carrier signal, b. amplifying said carrier signal, c. coupling said amplified carrier signal to a transmitting antenna to produce radio frequency current flow between said antenna and its ground.

d. utilizing the positive half cycles only said radio frequency antenna current to activate a first modulator connected to a source of first audio frequency intelligence signals, thereby amplitude modulating the positive half cycles of said antenna current with a first audio frequency intelligence signal, and e. utilizing the negative half cycles only of said radio frequency antenna current to activate a second modulator connected to a source of second audio frequency intelligence signals, thereby amplitude modulating the negative half cycles of said antenna current with a second audio frequency intelligence signal, f. thereby transmitting the modulated carrier signal.

2. The method of receiving a transmitted amplitude modulated radio frequency carrier signal produced by modulating the positive and negative half cycles of a transmitting antenna radio frequency current each with different audio frequency intelligence signals, the method comprising:

a. providing a first amplitude modulated receiving antenna circuit including a corresponding first receiving antenna with means in said first receiving antenna for allowing radio frequency current to flow in one direction only, whereby to be responsive only to one of the audio frequency intelligence signals, b. providing a second amplitude modulated receiving antenna circuit including a corresponding second receiving antenna with means in said second receiving antenna for allowing the radio frequency current to flow in the opposite direction only, whereby to be responsive only to the other of said audio frequency intelligence signals, c. amplifying the two audio frequency intelligence signals separately, and d. applying the two amplified audio frequency intelligence signals to separate audio speakers.

3. The method of transmitting and receiving amplitude modulated stereo, comprising:

a. generating a radio frequency carrier signal, b. amplifying said carrier signal, c. coupling said amplified carrier signal to a transmitting antenna to produce radio frequency current flow between said antenna and its ground, d. utilizing the positive half cycles only of said radio frequency antenna current to activate a first modulator connected to a source of first audio frequency intelligence signals, thereby amplitude modulating the positive half cycles of said antenna current with a first audio frequency intelligence signal, e. utilizing the negative half cycles only of said radio frequency antenna current to activate a second modulator connected to a source of second audio frequency intelligence signals, thereby amplitude modulating the negative half cycles of said antenna current with a second audio frequency intelligence signal, f. thereby transmitting the modulated carrier signal, g. providing a first amplitude modulated receiving antenna circuit including a corresponding first receiving antenna with means in said first receiving antenna for allowing radio frequency current to flow in one direction only, whereby to be responsive only to one of the audio frequency intelligence signals, h. providing a second amplitude modulated receiving antenna circuit including a corresponding second receiving antenna with means in said second receiving antenna for allowing radio frequency current to flow in the opposite direction only, whereby to be responsive only to the other of said audio frequency intelligence signals, i. amplifying the two audio frequency intelligence signals separately and j. applying the two amplified audio frequency intelligence signals to separate audio speakers.

4. Apparatus for transmitting amplitude modulated stereo, comprising:

a. radio frequency carrier signal generating means, b. radio frequency signal amplifying means coupling the generating means to a transmitting antenna for producing radio frequency current flow between said antenna and its ground, c. first and second microphone means for converting acoustical energy into audio frequency intelligence signals, d. first audio frequency signal modulating means connected to the first microphone means and interconnecting the transmitting antenna and its ground for operation only by the positive half cycles of the radio frequency antenna current, for modulation thereof by the first audio frequency signal, and e. second audio frequency signal modulating means connected to the second microphone means and interconnecting the transmitting antenna and its ground for operation only by the negative half cycles of the radio frequency antenna current for modulation thereof by the second audio frequency signal.

5. Apparatus for receiving transmitted amplitude modulated stereo produced by modulating the positive and negative half cycles of a transmitting antenna radio frequency current each with different audio frequency intelligence signals, the apparatus comprising:

a. amplitude modulated receiver means including a pair of separate antenna circuits each having an associated antenna, amplifying means and audio speakers, b. electron control means in the antenna of one of said pair of antenna circuits for allowing radio frequency current to flow in one direction only, and c. electron control means in the antenna of the other of said pair of antenna circuits for allowing radio frequency current to flow in the opposite direction only.

6. The apparatus of claim 5 wherein the electron control means in the antenna of each of said pair of antenna circuits is a radio frequency diode, the diodes being arranged in opposition one to the other.

* * * * *